US011116341B2

(12) United States Patent
Loar, Sr.

(10) Patent No.: US 11,116,341 B2
(45) Date of Patent: Sep. 14, 2021

(54) CAKE COVER

(71) Applicant: Robert Frank Loar, Sr., Grafton, WV (US)

(72) Inventor: Robert Frank Loar, Sr., Grafton, WV (US)

( * ) Notice: Subject to any disclaimer, the term of this patent is extended or adjusted under 35 U.S.C. 154(b) by 0 days.

(21) Appl. No.: 16/805,915

(22) Filed: Mar. 2, 2020

(65) Prior Publication Data

US 2020/0345164 A1 Nov. 5, 2020

Related U.S. Application Data

(60) Provisional application No. 62/841,212, filed on Apr. 30, 2019.

(51) Int. Cl.

| | |
|---|---|
| ***A47G 19/26*** | (2006.01) |
| ***F21V 35/00*** | (2006.01) |
| ***F21W 121/00*** | (2006.01) |
| ***A47G 19/30*** | (2006.01) |

(52) U.S. Cl.

CPC ..... *A47G 19/26* (2013.01); *F21V 35/00* (2013.01); *A47G 19/30* (2013.01); *A47G 2400/061* (2013.01); *F21W 2121/002* (2013.01)

(58) Field of Classification Search

CPC .. A45G 19/26; A45G 19/30; A45G 2400/061; F21V 35/00; F21W 2121/002

USPC ..... 99/645

See application file for complete search history.

(56) References Cited

U.S. PATENT DOCUMENTS

| | | | | |
|---|---|---|---|---|
| 4,938,688 | A * | 7/1990 | Wexler | A47G 19/26 312/284 |
| 5,582,478 | A * | 12/1996 | Ambrosino | F21S 6/001 362/234 |
| 8,668,088 | B2 * | 3/2014 | Donnelly | A47G 19/26 206/457 |
| 9,392,894 | B2 * | 7/2016 | Piccioni | A47G 19/265 |
| 10,463,180 | B1 * | 11/2019 | Donnelly | A47G 19/00 |
| 2003/0136277 | A1 * | 7/2003 | Okros | A47G 19/26 99/645 |
| 2012/0167784 | A1 * | 7/2012 | Zeigler | A47G 19/26 99/645 |
| 2014/0224798 | A1 * | 8/2014 | Johnson | A47G 19/00 220/212 |

FOREIGN PATENT DOCUMENTS

GB 2453811 * 4/2009

* cited by examiner

*Primary Examiner* — Laura K Tso

(74) *Attorney, Agent, or Firm* — Brennan, Manna & Diamond, LLC

(57) ABSTRACT

An improved cake cover for protecting and securing a cake, or other food item. The cake cover is preferably comprised of a washable enclosure having a plurality of receptacles positioned thereon for receipt of a plurality of interchangeable inserts, thereby allowing the user to customize the appearance and function of the cake cover. The plurality of inserts may include, without limitation, a candle holding insert, a light emitting insert and a sound emitting insert. An outer surface of the cake cover may further comprise decorative texturing that mimics the appearance of a traditionally baked cake, and/or may be constructed of a transparent or translucent material to enable the cake stored therein to be viewed through the cake cover. Finally, the cake cover may further comprise a securing means for securing the cover to a surface.

17 Claims, 5 Drawing Sheets

CAKE COVER

CROSS-REFERENCE TO RELATED APPLICATION

The present application claims priority to and the benefit of U.S. Provisional Application No. 62/841,212 filed on Apr. 30, 2019, which is incorporated herein by reference in its entirety.

BACKGROUND

The present invention relates generally to a new and improved cake or other food cover. More specifically, the invention relates to an improved cake cover that is comprised of, among other things, a series of removable inserts that can house a variety of items such as candles, lights, and music/mp3 players. Accordingly, the present specification makes specific reference thereto. However, it is to be appreciated that aspects of the present invention are also equally amenable to other like applications, devices and methods of manufacture.

Traditionally, a cake cover is a device that is placed over top of a cake or other dessert to enclose and protect the cake/dessert from outside contaminants and hazards. These contaminants and/or hazards can include, but are not limited to, airborne containments such as dust, pollen, dirt, hair, etc., or airborne germs that can be exposed to the cake in the form of a cough or a sneeze from an individual standing or sitting in relatively close proximity to the cake. Cake covers also serve an additional function of protecting the cake from being bumped or otherwise interfered with via human or animal contact, which could potentially damage the cake prior to its use in a celebration and/or its consumption.

More specifically, cakes are most commonly baked for celebratory occasions and, in particular, birthdays. During a birthday celebration, it is common practice to place and light wax candles on the birthday cake, and also sing "Happy Birthday" to the individual whose birthday is being celebrated. After the conclusion of the candle lighting and singing, the individual typically blows out the lighted candles on the birthday cake. This act of blowing out the candles further exposes the cake to a plurality of germs that could be present in the individual's breath, saliva, etc., which may land on the surface of the cake while the user is undertaking the act of blowing out the candles. The act of blowing out the candles and/or sneezing has the potential to contaminate the surface of the cake and, once the cake is cut and served to the celebration's participants, exposes any individual that eats a piece of the cake to the germs from the individual who blew out the candles.

Additionally, the practice of using traditional wax candles on a birthday cake can lead to candle wax melting onto the surface of the cake itself after each candle is lit. This melted wax must be removed before the cake is consumed, and creates an unnecessary hassle to the individuals who want to consume the cake or that are hosting the celebration. Traditional wax candles can also pose a fire hazard if a cake with lighted wax candles is left unattended or is bumped/knocked off of the surface that it is placed upon, thereby creating the potential for the candle flames to catch the surrounding area on fire. An event such as this could occur due to the fact that existing cake covers also do not have any means by which to secure the cake cover to the surface upon which it is placed. Stated differently, even though existing cake covers may protect the surface of the cake, they do not prevent the cake and the cake cover from being unintentionally knocked off of the surface upon which it rests by, for example, a child or a pet.

As previously stated, the inherent design of existing cake covers protect the cake from being exposed to contaminants, such as the saliva/bacteria of a user. However, the design of existing cake covers are not optimized for celebratory events such as birthdays, and are instead intended for more passive cake protection purposes. For example, a user may be concerned about the possibility of contamination of a cake via the saliva of the individual who is blowing out the candles of said cake, and may elect to use a cake cover to protect against this possibility. It is in this instance or any other number of similar situations when the inherent lack of optimization of existing cake covers becomes apparent.

More specifically, existing cake covers totally encase/cover the cake, and are typically comprised of an unflattering and opaque plastic material. This opaque construction completely hides the cake from the view of all those who are in attendance at a birthday party or other similar event until the cover is removed and, unfortunately, the cake is exposed to the potential for contamination. Typically, cakes for such events are decorated, and such decorations are typically made to be viewed by all in attendance, which existing cake covers do not allow for due to their generally opaque construction. In addition, if a user elects to use a cake cover at a birthday or other celebration, there is no means by which to light/blow out birthday candles with existing cake covers, as any candles inserted into the cake will ultimately be covered by the cake cover and thereby inaccessible to the user(s).

As previously stated, after the birthday candles have been lit on a birthday cake, the song "Happy Birthday" is traditionally sung to the individual whose birthday it is. This song is typically sung by all other individuals that are in attendance at the birthday party. However, some individuals may elect to play a pre-recorded/produced version of the song "Happy Birthday" or some other musical compilation. While this may be accomplished via a separate sound system or speaker that is normally not in close proximity to the birthday cake, meaning a user must be apart from the rest of the individuals present to actuate the playing of the pre-recorded "Happy Birthday" song on the chosen/available sound devices. This could possibly lead to that individual feeling separated/isolated from the rest of the birthday celebration based on their proximity to the actual birthday events. Many birthday celebrations also involve colorful decorative lights, which like the sound system, aren't typically in a location near the birthday cake when their operation must be commenced.

Therefore, there exists a long felt need in the art for an improved cake cover that overcomes the limitations of prior art cake covers. More specifically, there is a long felt need in the art for an improved cake cover that not only protects the cake, but that is also aesthetically appealing and that allows the use of traditional wax candles to be used with the cake cover itself, thereby preventing the candles from dripping wax onto the actual cake. There is also a long felt need in the art for an improved cake cover that enables the celebration participants to view the cake decorations without risking contamination to the cake itself, and that can be used to secure the cake cover and the cake to the surface upon which it rests. Additionally, there is a long felt need in the art for an improved cake cover that has the capability to serve as an interchangeable and centralized location for other aspects of the celebration, such as pre-recorded music and aesthetic lighting to enhance the party atmosphere.

Finally, there is a long felt need in the art for an improved cake cover that is relatively inexpensive to manufacture, and that is both safe and easy to use.

The present invention, in one exemplary embodiment, discloses an improved cake cover comprised of a washable and dishwasher safe plastic that has the appearance of a traditionally decorated rectangular birthday cake and/or that is transparent or translucent in nature to permit the participants to view the decorated cake through the cake cover. The body of the improved cake cover further comprises a series of handles to allow for easy removal of the improved cake cover from around the cake, and a securing mechanism for securing the cake cover, and therefore the enclosed cake, to the surface upon which it is placed. In a further preferred embodiment of the present invention, the top surface of the improved cake cover further comprises a plurality of receptacles for receipt of interchangeable inserts that can be used to house such items as lights, candles, phones/music players or other party enhancers.

In this manner, the improved cake cover of the present invention accomplishes all of the forgoing objectives, thereby improving the ability of a user to successfully protect a cake from contamination with an aesthetically pleasing cake cover without losing the ability to engage in traditional birthday party events, such as the lighting/blowing out of candles. In addition, the improved cake cover also ensures that the cake cover and cake enclosed therein are secure, and not accidentally damaged or knocked off of the surface upon which they are placed. Finally, the improved cake cover allows the user to personalize and enhance the party atmosphere by centralizing other aspects of the celebration, such as music, lighting, etc., in one location.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises an improved cake cover. The improved cake cover preferably comprises a generally rectangular enclosure having an exterior surface, a top, an interior space for receipt of a cake or other dessert, and a plurality of interchangeable inserts. The top of the cake cover preferably comprises a plurality of receptacles for receiving the interchangeable inserts, which may be comprised of candle holders, lighting mechanisms, music playing devices, etc.

In a further preferred embodiment, the enclosure may be comprised of a transparent or translucent, hand or machine washable material to allow participants to view the cake or dessert housed therein without exposing the same to contamination from, for example, germs, dust, pet dander, dirt, bodily fluids, airborne pathogens and the like. Additionally, the exterior surface of the improved cake cover may also be decorated in a manner similar to a cake, and may further comprise an attachment means for securing the improved cake cover to a surface, as well as handles for easily handling of the improved cake cover.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
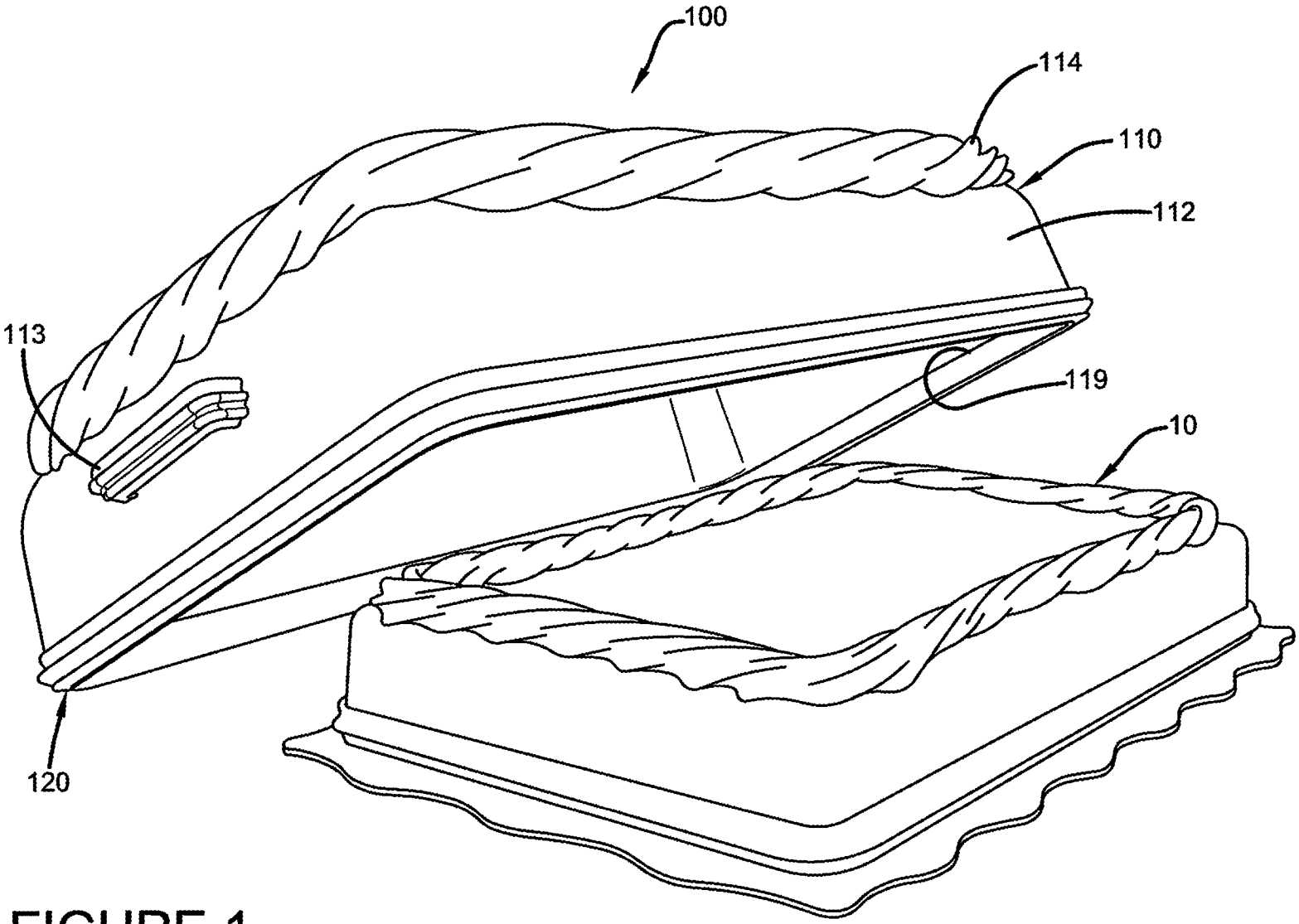
FIG. 1 illustrates a perspective view of a cake cover of the present invention partially covering a cake in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there exists in the art a long felt need for an improved cake cover that allows the user to successfully protect a cake or other dessert from dripping wax, contamination and the like, and that does not interfere with other birthday celebrations such as the use of lighted candles, music, party lighting, etc. In addition, there exist in the art a long felt need for an improved cake cover that is resistant to being inadvertently knocked off of the surface upon which it rests, and that is customizable by the user via a plurality of interchangeable inserts.

The improved cake cover of the present invention is designed to resemble a real and decorated birthday cake in its appearance, and/or may be constructed of a transparent or translucent material to enable participants to view the cake or dessert stored therein without prematurely removing the cake cover from the cake and exposing it to potential contamination. More specifically, certain design elements such as artificial textures that mimic frosting/icing may adorn the outer surface of the improved cake cover of the present invention to make it more visually appealing to the user, in contrast to opaque plastic typically used in existing cake covers.

Referring initially to the drawings, FIG. 1 illustrates a perspective view of one potential embodiment of a cake cover 100 of the present invention partially covering a cake 10 in accordance with the disclosed architecture. The cake cover 100 comprises an enclosure 110, a securing means 120, and a plurality of inserts 130, 140, and 150.

Figure 2:
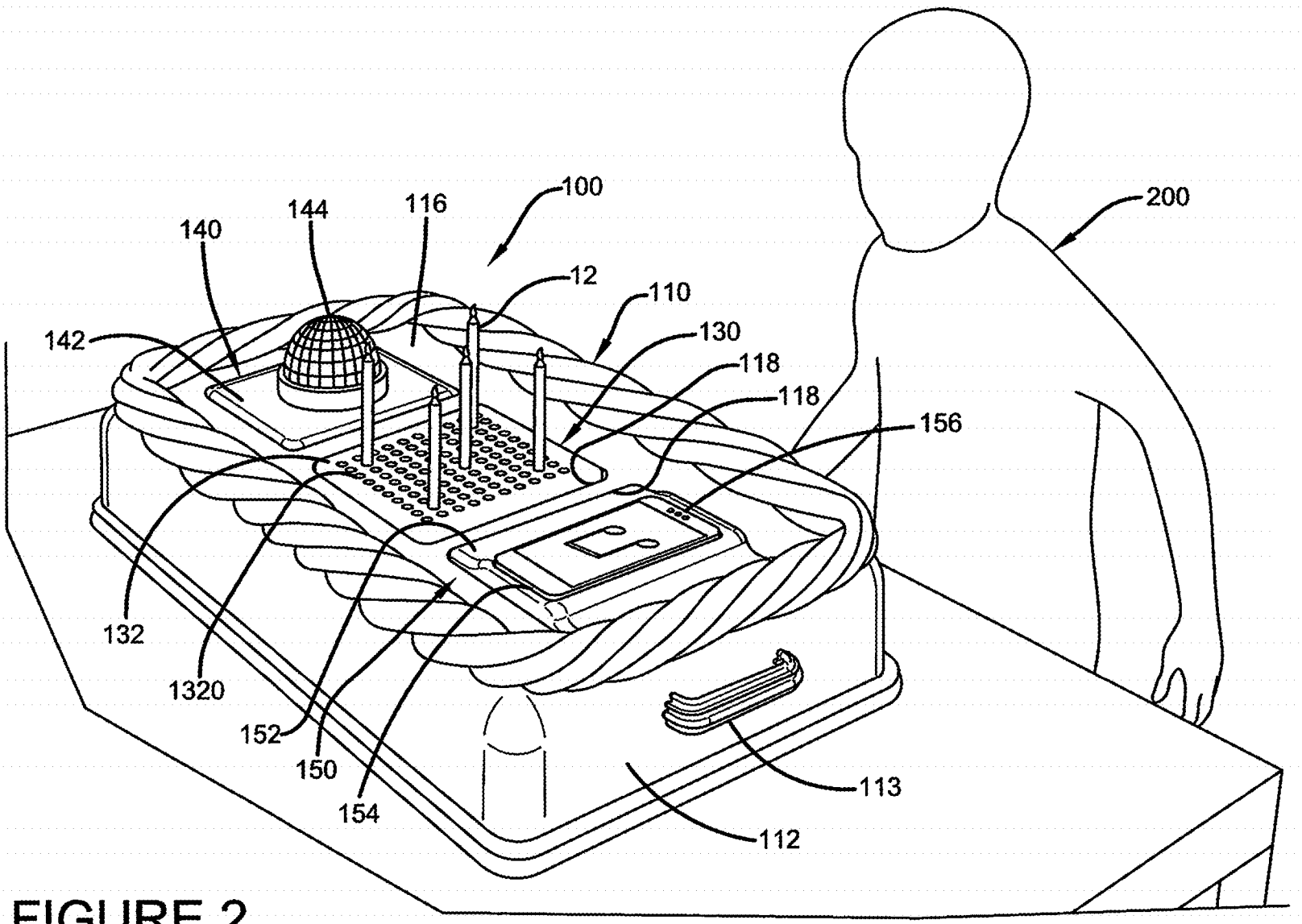
FIG. 2 illustrates a perspective view of a plurality of inserts of the cake cover of the present invention fully enclosing the cake in accordance with the disclosed architecture.
Figure 5:
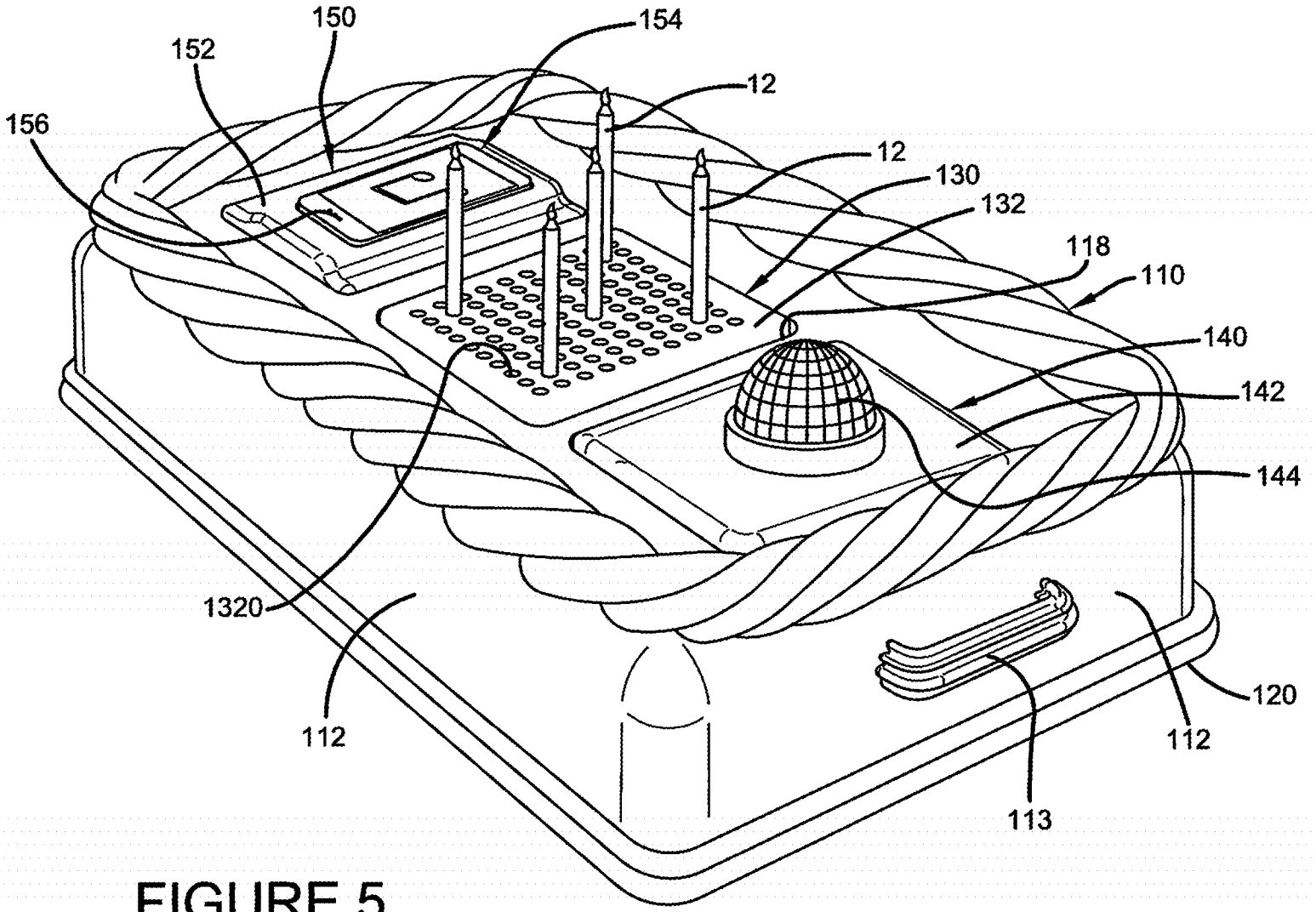
FIG. 5 illustrates a perspective view of the cake cover of the present invention in accordance with the disclosed architecture.

As best illustrated in FIGS. 1, 2 and 5, the enclosure 110 is preferably generally rectangular in shape, comprising an outer surface 112, one or more handles 113, a plurality of artificial decorations 114, a top portion 116, a plurality of insert receptacles 118, and an interior space 119. The enclosure 110 is preferably formed of a molded plastic or other suitable materials that is capable of being hand or machine washed to permit reuse of the cake cover 100, and to prevent unwanted contamination. The enclosure 110 may be manufactured of a transparent or translucent material to enable people to view the cake 10 stored therein without having to prematurely remove the cake cover 100 from the cake 10 and risk contamination thereto.

More specifically, the enclosure 110 is configured and sized to accommodate most traditionally sized cakes 10 within its interior space 119. Further, the one or more handles 113 are positioned along and attached to the outer surface 112 of the cake cover 100 to permit secure and easy handling of the same. The plurality of artificial decorations 114 are textured and may be colored in such a way as to mimic the color/texturing of icing on a traditionally baked cake. Similarly, the one or more handles 113 may also be manufactured to exhibit an icing textured appearance that matches the rest of the cake cover 100.

As best shown in FIGS. 2 and 5, the plurality of insert receptacles 118 are positioned along the top portion 116 of the outer surface 112 of the enclosure 110, and are indentations in the surface 112 thereof that are capable of receiving the plurality of inserts 130, 140, 150, as described more fully below. Nonetheless, one of ordinary skill in the art will identify the need to make the overall height of cake cover 100 sufficient so that the indentation of the plurality of insert receptacles 118 into the interior space 119 of the enclosure 110 will not interfere with the cake 10 being stored or housed therein so as to not disturb the decorations thereon. In a preferred embodiment of the present invention, the shape and size of the plurality of insert receptacles 118 and the various interchangeable plurality of inserts 130, 140, 150 would be consistent to enable a user 200 to configure the cake cover 100 in any manner to suit user need and/or preference. More specifically, any of the interchangeable plurality of inserts 130, 140, 150 would fit snugly in any of the plurality of insert receptacles 118.

As stated above, the cake cover 100 of the present invention may further comprise an integrated securing means 120 that removably secures the enclosure 110 and, by extension, the cake 10 contained therein to the surface upon which it rests. The integrated securing means 120 may be in the form of many different alternative embodiments. For example, the integrated securing means 120 may be comprised of a non-slip material, a suction device or an adhesive positioned along the bottom edge of the enclosure 110, as best shown in FIG. 1. The bond between the integrated securing means 120 and the surface to which it is attached should be strong enough to avoid the inadvertent sliding, knocking over or other disruption of the cake cover 100 and the cake 10 stored therein, but capable of being easily breached by the user 200 lifting upward (i.e., away from the surface upon which the cake cover 100 rests) on the cake cover 100 in a manner that does not disturb the integrity of the cake 10 stored therein.

Figure 3:
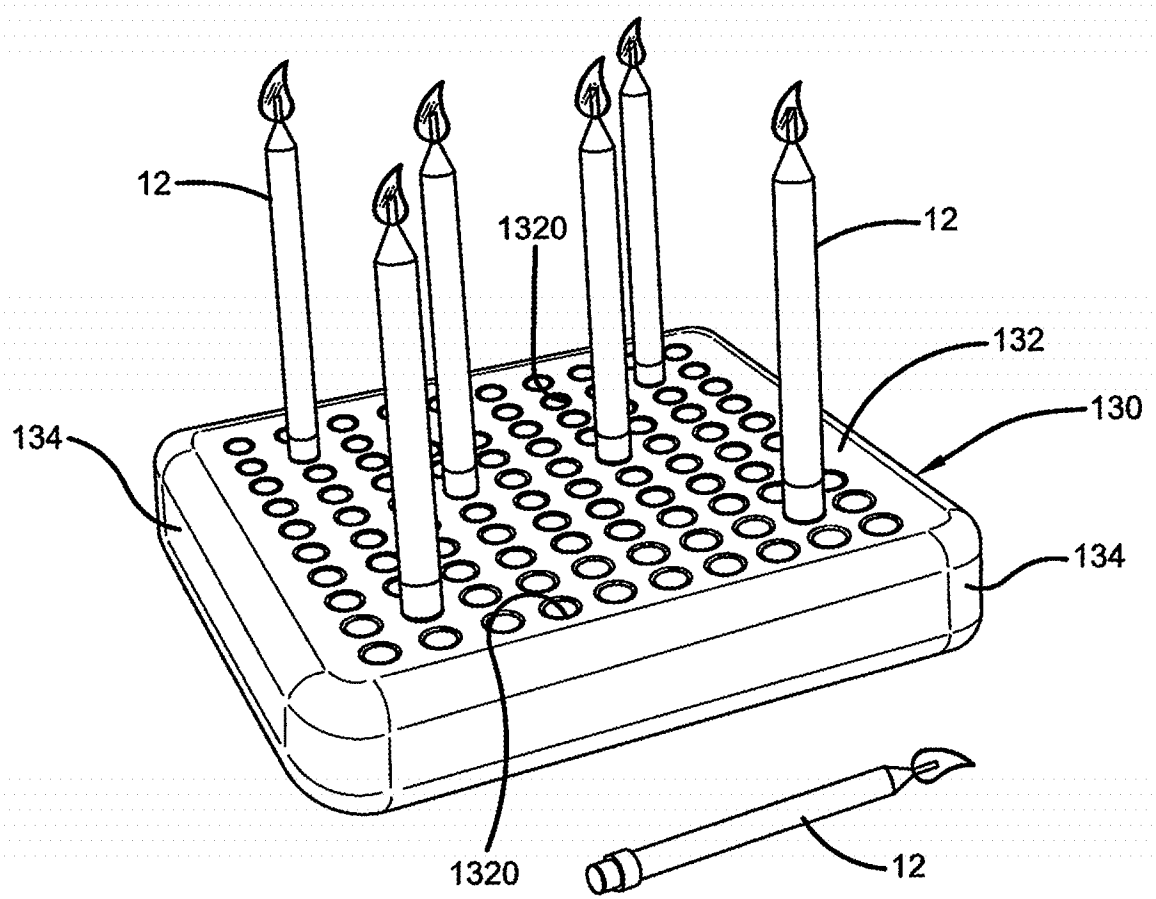
FIG. 3 illustrates a perspective view of a candle holder insert of the plurality of inserts present cake cover in accordance with the disclosed architecture.

The plurality of inserts 130 may comprise a candle holder insert 130. As best shown in FIG. 3, the candle holder insert 130 is generally shaped and sized to fit within any one of the plurality of insert receptacles 118 and to form a secure friction fit therewith, thereby permitting the user 200 the ability to organize and personalize the cake cover 100 of the present invention to suit user need and/or preference. The candle holder insert 130 comprises a top surface 132, a plurality of openings 1320, and a plurality of sides 134. More specifically, the plurality of openings 1320 may be formed in the top surface 132 of the candle holder insert 130 for receipt of a plurality of candles 12 therein. The candles 12 may be wax candles that can be lit and emit an actual flame, or may be artificial battery powered candles, as illustrated in FIG. 3. In either event, the presence of the enclosure 110 and the candle holder insert 130 between the candles 12 and the cake 10 will prevent the candles 12 from dripping wax onto cake 10, and will further prevent the cake 10 from coming into contact with the bodily fluids and/or germs (not shown) that may be contained on the breath of the user 200 blowing out the candles 12 or an inadvertent sneeze.

The plurality of inserts 130 may further comprise a light emitting insert 140. As best shown in FIGS. 2 and 5, the light emitting insert 140 is also generally shaped and sized to fit within any one of the plurality of insert receptacles 118 and to form a secure friction fit therewith, thereby permitting the user 200 the ability to organize and personalize the cake cover 100 of the present invention to suit user need and/or preference. The light emitting insert 140 comprises of a top surface 142, a light emitting device 144, such as a disco ball, strobe light, or other light emitting device, and a plurality of sides 146. The light emitting device 144 is preferably battery powered (not shown) and may further comprise an "on/off" switch (not shown) that can be operated on demand by the user 200 to conserve battery power. Nonetheless, it is also contemplated that the light emitting device 144 may also be capable of being operated by a smart phone or other smart device via a wireless means, such as blue-tooth technology, Wi-Fi, etc., or may be powered by an optional integrated power source (not shown) attached to the enclosure 110.

Figure 4:
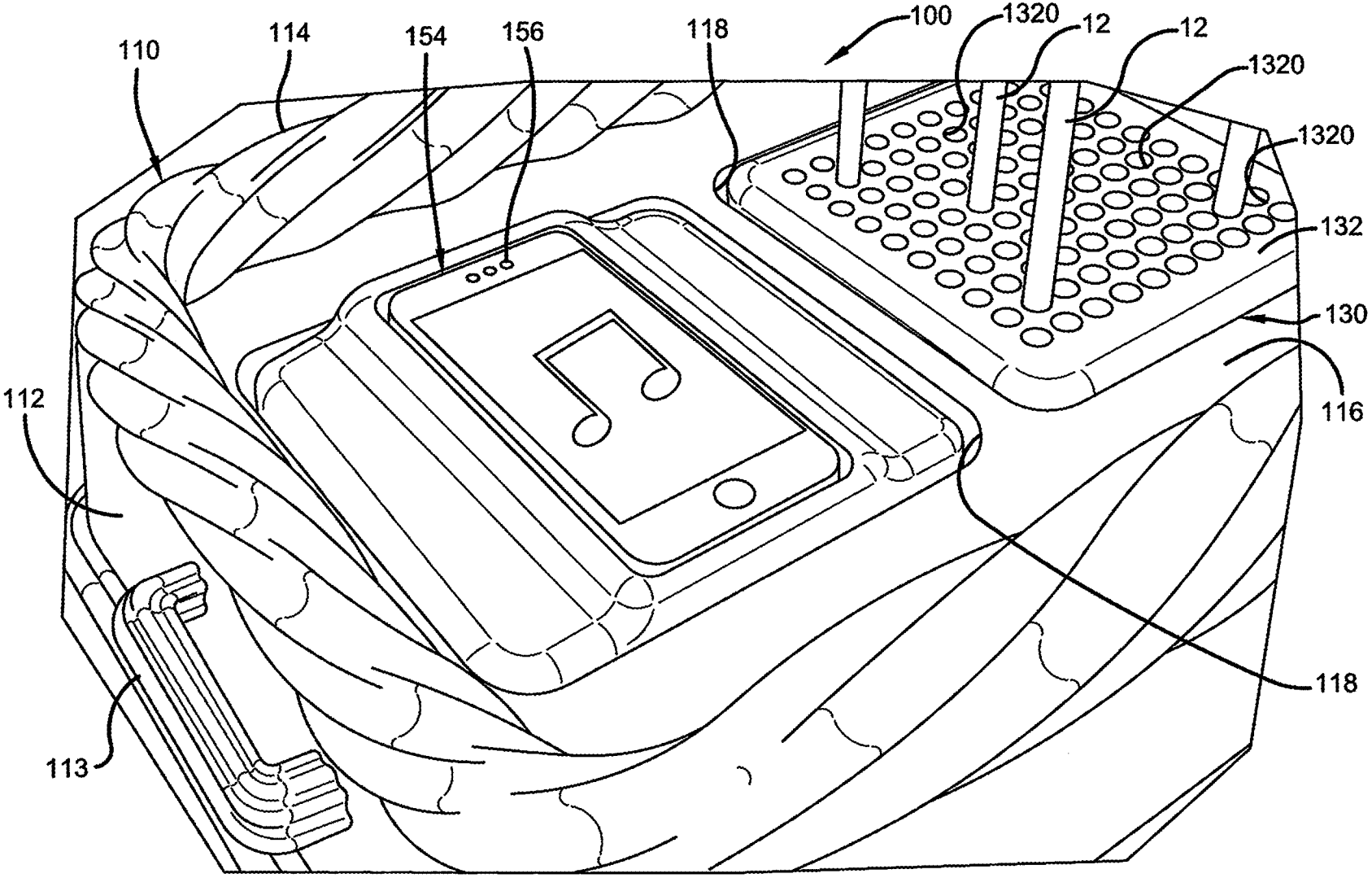
FIG. 4 illustrates a partial perspective view of the plurality of inserts positioned within a plurality of receptacles of the cake cover of the present invention in accordance with the disclosed architecture.

The plurality of inserts 130 may further comprise a sound emitting insert 150. As best shown in FIGS. 2, 4 and 5, the sound emitting insert 150 is also generally shaped and sized to fit within any one of the plurality of insert receptacles 118 and to form a secure friction fit therewith, thereby permitting the user 200 the ability to organize and personalize the cake cover 100 of the present invention to suit user need and/or preference. The sound emitting insert 150 comprises a top surface 152, a smart device 154, and a speaker 156. The smart device 154 may be a smart phone, a music player, an mp3 player or any other device capable of emitting a live stream or a prerecording of music, spoken word or other sounds. The speaker 156 may be integrated into the smart device 154, or it may be its own stand-alone device that communicates, via hardwire or wirelessly, with the smart device 154. If the speaker 156 is a stand-alone device, it is also preferably battery powered (not shown) and may further comprise an "on/off" switch (not shown) that can be operated on demand by the user 200 to conserve battery power.

It is further contemplated that other types of inserts could also be utilized that are shaped and sized to fit within the plurality of insert receptacles 118. Further, any of the above referenced inserts may further comprise an integrated wireless charging surface or integrated charging cable (not shown) that may be located within or below the insert receptacle 118 (e.g., on enclosure 110).

Notwithstanding the forgoing, the improved cake cover 100 of the present invention can by any suitable size, shape, and configuration as is known in the art without affecting the overall concept of the invention, provided that it accomplishes the above stated objectives. One of ordinary skill in the art will appreciate that the shape and size of improved cake cover 100 and its various components, as show in the FIGS. are for illustrative purposes only, and that many other shapes, sizes and configurations of improved cake cover 100 are well within the scope of the present disclosure. Although dimensions of the improved cake cover 100 and its components (i.e., length, width, and height) are important design parameters for good performance, the improved cake cover 100 may be any shape or size that ensures optimal performance during use and/or that suits user need and/or preference. This includes embodiments of the device that could be round or oval shaped to allow for the accommodation of round/oval cakes.

Having described the general structure of a preferred embodiment of the improved cake cover 100 and its various components above, its use will now be generally described. More specifically, a user 200 desiring to use the improved cake cover 100 of the present invention to protect a cake 10 will carefully place the improved cake cover 100 over the cake 10 so as to not disturb the cake or the decorations thereon, and press gently down on the enclosure so that the securing means engages with the surface upon which the cake 10 and the improved cake cover 100 rests, thereby securing the improved cake cover 100 and, by extension, the cake 10 to said surface.

The user 200 may then personalize the top surface 116 of the enclosure 110 to suit the user's needs and/or preferences. More specifically, and by way of example, the user 200 may position one or more of candle holder insert 130, light emitting insert 140 and/or sound emitting insert 150 into the various insert receptacles 118 positioned along the top portion 116 of the enclosure 110, and the improved cake cover 100 is now ready to be utilized for a celebration, such as a birthday. Once the celebration is underway, the user 200 can then use the handles 113 on the enclosure 110 to gently pull the improved cake cover 100 of the surface on which it rests to expose the cake 10, which may then be consumed by the celebration's participants. Nonetheless, the improved cover of the current invention is not limited to use with cakes and desserts and can be used with other types of foods as well.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cake cover comprising:

an enclosure having an outer surface and defining an interior space for receipt of a cake;

a suction device positioned along a bottom edge of the enclosure for securing the enclosure to a surface;

a plurality of receptacles on the outer surface; and a plurality of inserts corresponding to the plurality of receptacles.

2. The cake cover of claim 1, wherein the enclosure is formed of a transparent or a translucent material.

3. The cake cover of claim 1, wherein the enclosure further comprises at least one handle.

4. The cake cover of claim 1, wherein at least one of the plurality of inserts emits pre-recorded music.

5. The cake cover of claim 1, wherein at least one of the plurality of inserts is a light source.

6. The cake cover of claim 1, wherein at least one of the plurality of inserts is a candle holder.

7. The cake cover of claim 6, wherein the candle holder has a plurality of openings therein for receipt of one or more candles.

8. The cake cover of claim 5, wherein the light source is a rotating disco ball.

9. A cake cover comprising:

an enclosure having an outer surface and defining an interior space for receipt of a cake;

an adhesive element positioned along a bottom edge of the enclosure for securing the enclosure to a surface;

a first receptacle positioned along the outer surface and a candle holding insert positioned in the first receptacle; and a second receptacle positioned along the outer surface and at least one of a light emitting insert or a sound emitting insert positioned in the second receptacle.

10. The cake cover of claim 9, wherein the enclosure is formed of a transparent or a translucent material.

11. The cake cover of claim 9, wherein the enclosure further comprises at least one handle.

12. The cake cover of claim 9, wherein the candle holding insert has a plurality of openings therein for receipt of one or more candles.

13. The cake cover of claim 9, wherein the enclosure is further comprised of an integrated power supply.

14. A food cover comprising:

an enclosure having an outer surface and defining an interior space for receipt of a food item;

a first receptacle positioned along the outer surface and a candle holding insert positioned in the first receptacle;

a second receptacle positioned along the outer surface and a light emitting insert positioned in the second receptacle; and a third receptacle positioned along the outer surface and a sound emitting insert positioned in the third receptacle, wherein the sound emitting insert comprises a smart phone or a digital music player.

15. The food cover of claim 14, wherein the enclosure is formed of a transparent or a translucent material.

16. The food cover of claim 14 further comprising a securing means for securing the enclosure to a surface.

17. The food cover of claim 16, wherein the securing means is at least one of a non-slip material, a suction cup and an adhesive surface.

* * * * *